US005115164A

United States Patent [19]

Jeong et al.

[11] Patent Number: 5,115,164

[45] Date of Patent: May 19, 1992

[54] DISPENSER CATHODE

[75] Inventors: Jong-in Jeong; Jong-seo Choi; Hwan-cheol No; Kyu-nam Ju, all of Suwon, Rep. of Korea

[73] Assignee: Samsung Electron Devices Co., Ltd., Kyunggi, Rep. of Korea

[21] Appl. No.: 611,688

[22] Filed: Nov. 7, 1990

[30] Foreign Application Priority Data

Nov. 10, 1989 [KR] Rep. of Korea ..... 89-16316

[51] Int. Cl.[5] ..... H01J 1/28

[52] U.S. Cl. ..... 313/346 DC

[58] Field of Search ..... 313/346 DC, 346 R

[56] References Cited

U.S. PATENT DOCUMENTS 3,159,461 12/1964 MacNair ..... 313/346 DC
3,699,378 10/1972 Buescher et al. ..... 313/346 DC
4,165,473 8/1979 Falce ..... 313/346 DC
4,369,392 1/1983 Hotta et al. ..... 313/346 DC X
4,823,044 4/1989 Falce ..... 313/346 DC

OTHER PUBLICATIONS

Lipeles, R. A. and Kan, H. K. A., "Chemical Stability of Barium Calcium Aluminate Dispenser Cathode Impregnants," Applications of Surface Science 16 (1983) 189-206, North-Holland Publishing Company.

*Primary Examiner*—Palmer C. DeMeo
*Attorney, Agent, or Firm*—Cushman, Darby & Cushman

[57] ABSTRACT

A dispenser cathode comprises an electron emissive material containing $BaAl_4$ and Ni, the porous metal base body and a sleeve. The activation aging time of the dispenser cathode according to the present invention is shortened greatly as compared with the conventional dispenser cathode and therefore, the productivity can be increased.

2 Claims, 2 Drawing Sheets

DISPENSER CATHODE

FIELD OF THE INVENTION

The present invention relates to a dispenser cathode, and particularly to a cavity reservoir type dispenser cathode in which the activation aging time is shortened greatly.

BACKGROUND OF THE INVENTION

The reservoir type dispenser cathode comprises an electron emissive material made by press-molding tungsten and barium calcium aluminate, a porous metal base body positioned on the upper portion of the electron emissive material and provided with the diffusing cavity for diffuse Ba, a container storing the electron emissive material, and a sleeve supporting and fixing said container and enclosing the heater.

Some additives are added to the porous metal base body and the electron emissive material based on the above mentioned basic structure or material in order to lower the operating temperature of the cathode or enhance the current density. For example, as described in U.S. Pat. No. 4,823,044, issued to Ceradyne, Inc., suitable amount of Ir, Os, Ru, Re, etc., permeates into the porous metal base body. This cavity reservoir type dispenser cathode is inexpensive in manfacturing cost and has the current density of over 10 $A/cm^2$.

But the aforesaid cavity reservoir type dispenser cathode is disadvantageous in that the time required for activation aging i.e., the time required for forming monatomic layer on the inner wall and the surface of the cavity of the porous metal base body is as long as approximately 10 to 30 hours, thereby decreasing the productivity of the product. The reason why the time required for the activation aging is lengthened is that diffuse Ba from the electron emissive material is diffused gradually through the cavity of the porous metal base body positioned on the electron emissive material and lastly it reaches the surface of the porous metal base body. In more detail, when diffuse Ba generated by thermal energy from the heater passes through the cavity and the monatomic layer is formed gradually on the surface of the porous metal body, the monatomic layer is not formed on the surface of the porous metal base body until Ba layer is sufficiently formed on the inner wall of the cavity (i.e. until the concentration thereof reaches the state of the saturation.).

To overcome these problems, there is a method to increase the produced amount of Ba. However, this method should increase the heat amount generated from the heater and therefore may shorten the lifetime of the heater and vaporize excessive amount of Ba. Thus, the lifetime of the cathode itself i.e. the time which can maintain the thermal electron emission for a long period may be short. Further, if vaporized Ba which does not contribute to form the monatomic layer is attached to a part of the periphery of the cathode, the lowering of the performance and the deterioration of the product itself are resulted.

SUMMARY OF THE INVENTION

It is an object of the present invention to provide a dispenser cathode which maintains an electron emission for a longer period and shortens the activation aging time greatly.

To accomplish the above object, the dispenser cathode according to the present invention comprises an electron emissive material and a porous metal base body, wherein said electron emissive material contains a suitable amount of $BaAl_4$ and Ni and includes barium calcium aluminate as base material.

BRIEF DESCRIPTION OF THE DRAWINGS

The above objects and other advantages of the present invention will become more apparent by describing the preferred embodiment of the present invention with reference to the attached drawings, in which.

DETAILED DESCRIPTION OF PREFERRED EMBODIMENTS

Figure 1:
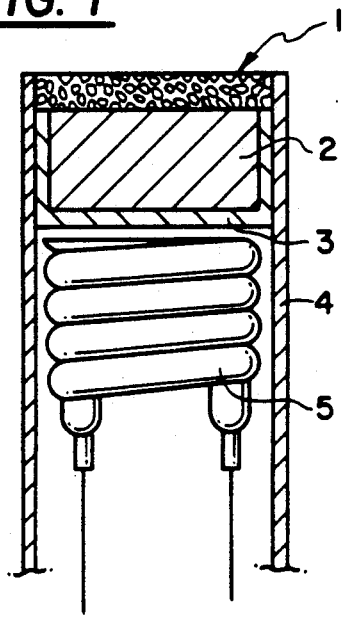
FIG. 1 is a cross-sectional view of the cavity reservoir type dispenser cathode.

FIG. 1 is a cross-sectional view of the cavity reservoir type dispenser cathode of the present invention. In the drawing, the above dispenser cathode comprises an emissive material 2 stored in a reservoir 3, a porous tungsten metal base body 1 disposed on the top of the electron emissive material 2, and a sleeve 4 supporting and fixing these and enclosing a heater 5.

Said electron emission material 2 is prepared by mixing barium calcium aluminate, $BaAl_4$ powder, Ni powder and W powder and then press/molding the mixture into a predetermined shape, in which the amount of said $BaAl_4$ +Ni powder is preferably 5 to 30 wt % and within this range, the property of said material 2 does not vary. However, if the amount of said $BaAl_4$ +Ni powder is above 30 wt %, the characteristics of the cathode is lowered because Ba producing reaction proceeds suddenly at the beginning of the activation and a molten material is formed by a temperature rise caused by a reaction heat.

Said barium calcium aluminate is prepared by mixing $BaCO_3$, $CaCO_3$ and $Al_2$ $CO_3$ powder at a mole ratio of 4:1:1 and baking them.

A metal powder mixture in said mixing ratio is shaped into an electron emissive material 2 contained in the reservoir 3 by using a press zig.

The porous metal base body 1 disposed at the top of the electron emissive material 2 is fabricated by press-molding and sintering heat resistant metal powder such as tungsten, and then is fixed to the reservoir 3 by welding.

The electron emissive material thus formed includes $BaAl_4$ and Ni powder, so it can produce a monatomic layer rapidly through activation aging.

Figure 2A:
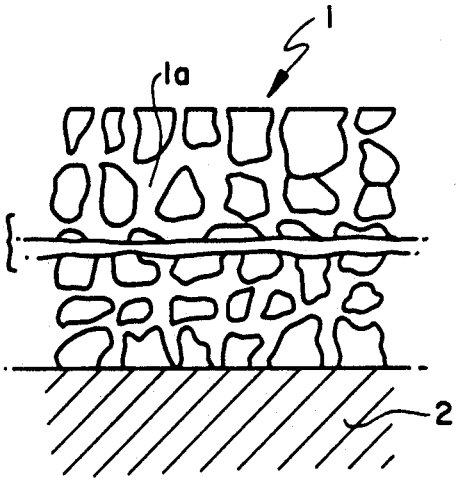
FIG. 2A is an extracted cross sectional view of the porous metal base body positioned on the upper portion of the electron emissive material in the reservoir type dispenser cathode, wherein monatomic layers are not formed on the inner wall of the cavity of the porous metal base body and its surface.

FIG. 2A illustrates the porous metal base body prior to activation aging, in which the cavity 1*a* of porous metal base body 1 maintains its original state formed during fabricating process.

Figure 2B:
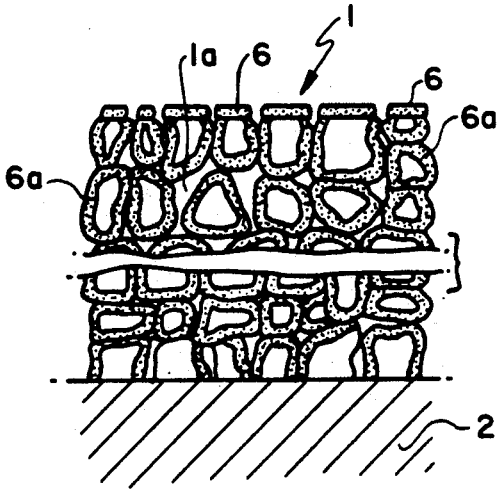
FIG. 2B is an extracted cross sectional view of the porous metal base body positioned on the upper portion of the electron emissive material in the reservoir type dispenser cathode, wherein monatomic layer are formed on the inner wall of the cavity of the porous metal base body and its surface.

FIG. 2B illustrates the porous metal base body after activation aging, in which Ba layer 6*a* is formed in the inner wall of the cavity 1*a* and a monatomic layer 6 consisting of Ba—W—O is formed on its surface.

In more detail, $BaAl_4$ and Ni included in an electron emissive material during this activation aging are reacted suddenly at a temperature of about 700° C. and produces evaporated Ba and 4 AlNi. The reaction of barium calcium aluminate and tungsten which is a reducing agent by thermal energy generated from a heater and the reaction of $BaAl_4$ and Ni produce an evaporated Ba.

At this time the chemical reaction formula is as follows.

$$BaAl_4 + 4Ni \rightarrow 4AlNi + Ba \uparrow$$

Thus, Ba layer 6*a* is formed by a sufficient evaporated Ba through the cavity 1*a* of porous metal base body 1 and a monatomic layer 6 is formed by evaporated Ba reacting the surface of porous metal base body 1.

Figure 3:
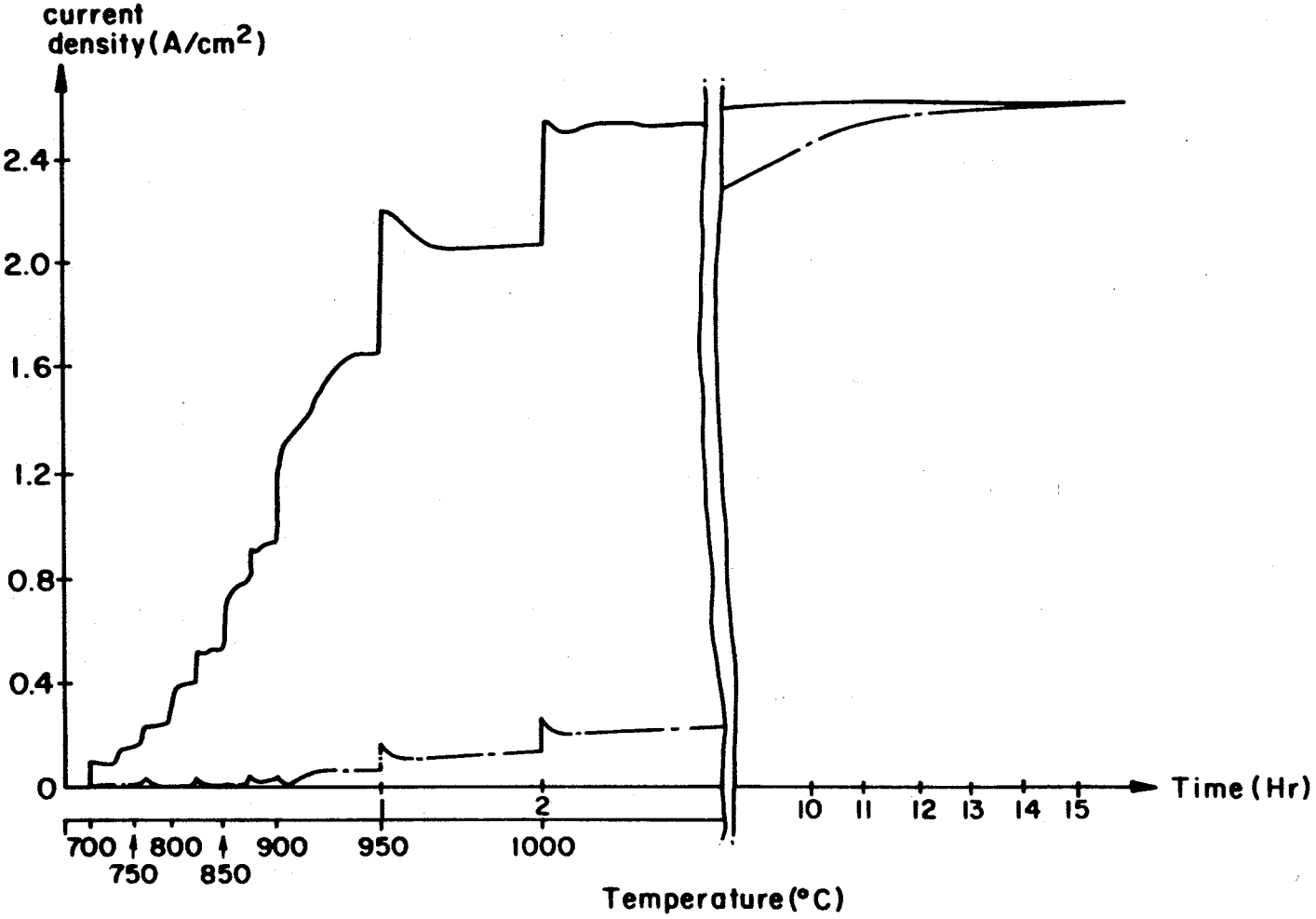
FIG. 3 illustrates the comparative line diagram of the current density versus time and temperature when the activation aging of a dispenser cathode of the present invention and the conventional dispenser cathode are carried out.

FIG. 3 illustrates the comparative line diagram of the current density versus time and temperature, when the activation aging of a dispenser cathode of the present invention and the conventional dispenser cathode are carried out.

As can be seen from FIG. 3, the activation aging time of the conventional dispenser cathode, which is required for the current density to reach more then approximately 2.4 $A/cm^2$, is 10 hours and that of the present invention is 2 hours.

As described above, the dispenser cathode according to the present invention can shorten aging time by promoting the activation aging function of $BaAl_4$ and Ni, in which production of the cathode per unit hour increases and also its lifetime is lengthened due to the increase of Ba production.

What is claimed is:

1. A dispenser cathode comprising:

an electron emissive material stored in a reservoir comprising barium calcium aluminate and tungsten:

a porous metal base body disposed on the top of said electron emissive material; and a sleeve supporting said reservoir and enclosing a heater;

wherein said electron emissive material further comprises nickel and an alloy of barium and aluminum.

2. The dispenser cathode as claimed in claim 1, wherein the content of said nickel and said alloy of barium and aluminum is from 5 to 30% by weight based on said electron emissive material.

* * * * *